United States Patent [19]

LeFrancois

[11] 4,181,541

[45] Jan. 1, 1980

[54] THERMOCHEMICAL TREATMENT SYSTEM AND PROCESS

[75] Inventor: Philippe LeFrancois, Neuilly-en-Thelle, France

[73] Assignee: Vide et Traitement S.A., Neuilly-en-Thelle, France

[21] Appl. No.: 875,762

[22] Filed: Feb. 7, 1978

[30] Foreign Application Priority Data

Feb. 8, 1977 [FR] France ..... 77 03501

[51] Int. Cl.[2] ..... C23C 11/12; C23C 13/02; C23C 13/12

[52] U.S. Cl. ..... 148/16.6; 148/16; 204/164; 204/177

[58] Field of Search ..... 204/164, 177; 148/16, 148/16.6

[56] References Cited

U.S. PATENT DOCUMENTS

| | | | |
|---|---|---|---|
| Re. 28,918 | 7/1976 | Humbert | 204/177 |
| 3,035,205 | 5/1962 | Berghaus et al. | 204/164 |
| 3,190,772 | 6/1965 | Berghaus et al. | 148/16.6 |
| 3,571,558 | 3/1971 | Hogan, Jr. | 219/130.4 |

*Primary Examiner*—Arthur J. Steiner
*Attorney, Agent, or Firm*—J. Harold Nissen

[57] ABSTRACT

Thermochemical Treatment System and Process for the treatment of steel or steel alloys by ionic bombardment. Two successive stages of operation are involved in which during the first stage, a DC voltage is applied across the electrodes of a furnace so that the furnace operates at a point far enough away from the arc formation zone to prevent formation of an arc and lies in the zone of abnormal discharge. During the second stage, a succession of pulses of voltage pulses of high voltage but of limited energy is applied to the furnace electrodes, and the operating point of the furnace moves along the voltage-intensity curve to a limit point far enough away from the arc formation zone, so that no arc formation takes place.

5 Claims, 2 Drawing Figures

THERMOCHEMICAL TREATMENT SYSTEM AND PROCESS

BACKGROUND OF THE INVENTION

1. Field of the Invention

This invention is concerned with the thermochemical treatment of metals. More particularly, the invention is concerned with the treatment of steel or steel alloys by ionic bombardment.

2. Description of the Prior Art

It is well known to treat metals thermochemically, and that the thermochemical treatment of metals is particularly suitable for the nitridation of metals and alloys. The nitridation of metals and alloys is obtained by means of an electric discharge through a rarefied gas.

As is well known, the metal pieces which are to be treated are placed into a furnace containing a gas such as ammonia $NH_3$. For this purpose, the gas is brought or raised to a temperature of several torrs.

The furnace includes a cathode and an anode which is connected across a high voltage or HT DC feed circuit. The cathode serves as a support for the pieces to be treated in the furnace.

In order to carry out the thermochemical treatment in a furnace of the aforementioned type, two solutions or systems have been proposed.

The first solution or system proposes that after a transitory period, a potential difference be established between the cathode and the anode. And, after the transitory period, the furnace will be operated so as to hold to a portion of the voltage-intensity curve proper to an electric discharge in the gas contained in the furnace, close to the arc regime. This portion is called the "abnormal discharge zone". This solution makes it possible to obtain a substantial dissipation of energy at the cathode.

As noted heretofore, while this solution makes it possible to obtain, at the cathode, a substantial dissipation of energy, it consequently causes a fast heating of the piece. But, this solution does not provide for good homogeneity, particularly in the treatment of pieces that are twisted or have drilled holes or cavities.

In addition, its principal drawback resides in the fact that, since we are close to the arc regime, arcs are frequently struck. In spite of the use of arc-breaking systems, operating close to the arc regime runs the risk of damaging the pieces.

The second system or solution to the problem of thermochemical treatment consists in the use of HT (high voltage) current pulses in place of the DC current. The total energy of the HT current pulses however, has a predetermined value calculated in such a way that it will be impossible to reach the zone corresponding to the arc regime in the voltage-intensity discharge curve.

With the aforesaid process, ions with high kinetic energy are essentially obtained but in a limited quantity. This makes it possible to enhance the quality of the treatment and its homogeneity without entraining too great a rise in temperature that would lead to poor retention of the dimensions and precision of the piece undergoing treatment.

Nevertheless, one drawback of this process consists in the fact that the treatment temperature is obtained only at the end of a rather long period of time.

It is therefore an object of the invention to eliminate the drawbacks of the two solutions discussed above.

SUMMARY OF THE INVENTION

In order to accomplish the aforesaid object, the present invention proposes a mixed solution which includes a two stage operation.

In the first stage of operation, it is proposed to operate the furnace with the aid of a constant DC voltage making it possible to obtain an operating point situated in the abnormal discharge zone, but far enough from the arc formation zone to avoid any risk of arc formation. And, in the second stage of operation, after a treatment temperature is reached, it is proposed to operate the furnace in a voltage pulse regime. The heat dissipation of this type of operation in the voltage pulse is sufficient to maintain the treatment temperature of the piece.

To these ends, the invention consists in the provision of a process for the thermochemical treatment of metals such as steels or steel alloys, by ionic bombardment, in a furnace in which the gas serving for the treatment is brought to a very low pressure, and which comprises an anode and a cathode on which are disposed the pieces to be treated, and the improvement comprises two successive stages; in the first stage between the anode and the cathode, there is established a DC voltage, calculated in such a way that the operating point of the furnace lies in the zone of abnormal discharge of the voltage-intensity curve of the furnace, but at a point far enough from the arc formation zone to elminate as far as possible the possibility of formation of an arc, this first stage being intended essentially to bring the piece to be treated as quickly as possible to treatment temperature, and in the second stage there is established between the cathode and the anode, a succession of pulses of voltage pulses with HT (high voltage) but limited energy, in the course of each of which the operating point of the furnace moves along the voltage-intensity curve to a limit point far enough from the arc formation zone, so that the formation of an arc may not occur.

In carrying out the aforesaid process, the energy of each of the said voltage pulses is quantified by a capacitor. In carrying out the process, a feed circuit is provided which makes it possible to furnish, successively, a DC (continuous) voltage and a succession of voltages.

The invention also includes the provision of a system which includes a furnace and a feed circuit. The feed circuit provides both the DC voltage and the succession of voltages or voltage pulses. To provide for these two types of feeds, the feed circuit comprises a set of commutations with four switches mounted in a bridge, in which two opposite nodes are connected to a source of DC (continuous) voltage and the other two nodes are connected to a capacitor in series with the primary of a transformer, the secondary of which is connected to the electrodes of the furnace through a rectifier. The secondary of the transformer comprises two outputs, namely one output for the continuous regime and one output for the pulsed regime, and a switch is provided for the successive actuation of these two outputs.

Accordingly, a main feature of the invention is the provision of a system including a furnace in which those two types of operation can be carried out by supplying the furnace from a single source of electric current feed.

In order that the invention may be more clearly understood and readily carried into effect, it will now be described more fully with reference to the accompanying drawing.

Figure 1:
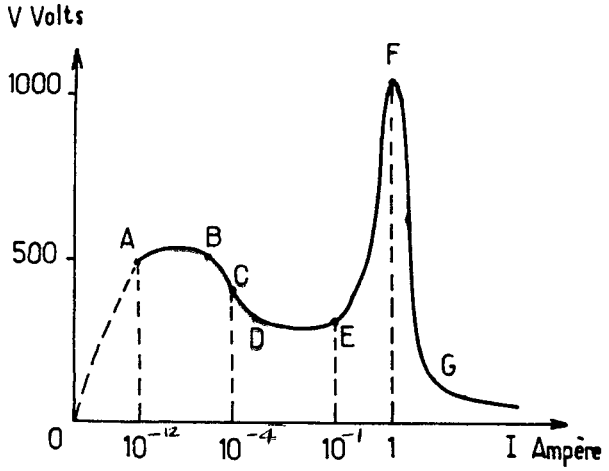
FIG. 1 is a graphical representation of a voltage-intensity curve characteristic of an electric discharge in a gas.

Referring to the drawing, and in particular to FIG. 1 thereof, the two known modes of operation of the furnace are explained in connection with the voltage-intensity discharge curve which is characteristic of the electric discharge in a gas. The curve for ease of discussion and explanation of the operation is separated into different zones of operation.

| ZONE | OPERATION |
|---|---|
| OA | Seat of very weak currents |
| AB | Portion where the voltage is substantially constant and which corresponds to the Townsend discharge regime |
| BC | Zone of subnormal luminescence |
| DE | Zone of normal luminescence |
| EF | Zone of abnormal discharge |
| FG | Arc regime zone |

The operation of the first stage or system will now be explained with reference to FIG. 1. In order to obtain an effective treatment of the material, it is necessary to obtain ions endowed with substantial kinetic energy.

In carrying out the thermochemical treatment according to the first system, a continuous potential difference is applied between the cathode and the anode. After a transition regime, this application of the continuous potential difference permits the obtaining of a permanent operating point close to point F (FIG. 1), i.e., close to the arc regime zone. As noted heretofore, in order to obtain ions with high kinetic energy, it is important to be positioned as closely as possible to point F.

The point of permanent operation is close to point F.

It should be noted that, before reaching the point of permanent operation, the point of operation evolves in time (transition regime), following, successively, the sections OA, AB, BC, CD, DE, and finally arriving at the point of permanent operation on section EF.

In the course of this transition period, the quantity of energy $E_t$ used, is well defined and can be calculated experimentally.

Turning now to an explanation of the operation of the second system, which provides for the application of HT (high voltage) pulses across the cathode and the anode of the furnace so that there will be no substantial arc formation danger. With this second system, pulses (of high voltage) which are much higher than the operating voltage of the first system of operation are emitted between the cathode and the anode. The total energy of these HT pulses are limited in such a manner so as to have only a transition regime. The total energy is limited so that the operation point will move along the voltage-intensity curve, from point O to a limit point distant from point F, so that there is no substantial arc formation danger.

The fact of starting from a high voltage means ions are obtained with high kinetic energy, and consequently a more effective treatment of the piece, with less heating, since the total energy and the density of the ions are limited.

As mentioned above, the invention proposes to combine the two types of operation cited above, using in a first stage the first type of operation until the piece to be treated is brought to the treatment temperature, and then using the second type of treatment.

It should be noted in this respect that the combination proposed by the invention is not a juxtaposition of two treatment processes. As a matter of fact, the first type of operation is designed essentially to heat the piece rapidly. Consequently, it is not necessary for the operating point to lie as close as possible to the discharge zone in order to obtain substantial kinetic energy, and thereby risk having the formation of an arc regime. In practice, an operating point far enough from point F is chosen so that no arc regime will be produced; this is not a drawback, since operation is not in a treatment phase. As a mater of fact, the treatment properly speaking is carried out essentially in the second mode of operation of the furnace.

Figure 2:
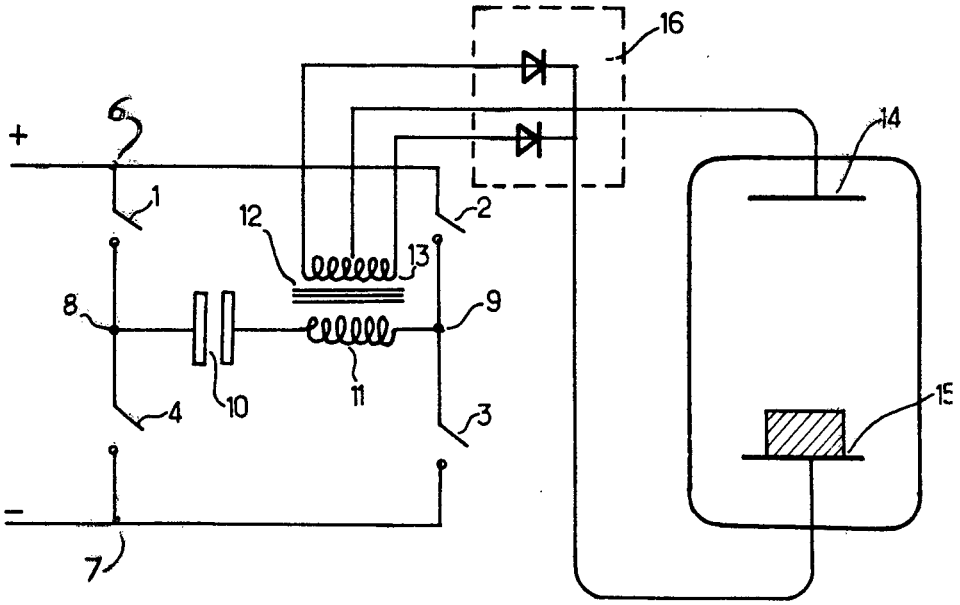
FIG. 2 is a diagrammatic representation of the system which includes a furnace and a feed system according to the invention for carrying out the two stage process. The feed system includes an electrical circuit for providing two distinct feeds to the furnace.

Referring to FIG. 2 which illustrates a system according to the invention for operating a furnace having a cathode electrode 14 and an anode electrode 15.

The system shown in FIG. 2 is an electric current feed device which enables the furnace to be operated in two modes of operation. The electric current feed device comprises a set of commutations having four individually and separably operable switches 1, 2, 3 and 4 mounted in a bridge circuit, a capacitor 10, a transformer 12 and an output rectification circuit 16 connected across the cathode and anode electrodes 14, 15.

Four nodes 6, 7, 8 and 9 are provided. Nodes 6 and 7 connect the switches 1, 2, 3 and 4 forming the set of commutations to a source of DC voltage. Transformer 12 includes a primary winding 11 connected in series with one plate of capacitor 10 and a secondary center tapped winding 13. The opposite ends of the secondary winding 13 are connected to the inputs of diode rectifiers in a rectification circuit 16 and from the outputs of the diode rectifiers they are connected together to the anode electrode 15. The center tap of secondary winding 13 is connected to the cathode electrode 14. The series connection of capacitor 10 and primary winding 11 are connected between the other two nodes 8 and 9 with the other plate of capacitor 10 connected to node 8. Switch 1 is connected between nodes 6 and 8; switch 2 is connected between nodes 6 and 9; switch 3 is connected between nodes 7 and 9; and, switch 4 is connected between nodes 7 and 8.

The electric current feed device is operated in the following manner to provide for the second mode of operation, and the pulse regime is obtained in two stages. In stage 1, switches 1 and 3 are closed, switches 2 and 4 are opened, and capacitor 10 is charged by the source of the DC voltage. Then in stage 2, the open switches 2 and 4 are closed, and the closed switches 1 and 3 are opened. This causes capacitor 10 to discharge through the primary winding 11 of transformer 12 to provide the HT voltage pulses.

It is clear that the pulse obtained on the secondary 13 of the transformer, and hence on the anode 14 and cathode 15 of the furnace, has a high voltage (transformation ratio). But the total energy of the pulse is solely a function of the voltage at the terminals of capacity 10 and a function of the capacity value of capacitor 10. Consequently, in order to prevent the operating point of the furnace from reaching a dangerous zone, it is necessary only to play on the value of the feed voltage and/or on the value of capacitor 10.

To obtain the first type of operation, a commutation regime of switches 1, 2, 3 and 4 is established in the same order, but at a higher frequency so that at the output of rectifier 16 a DC voltage is obtained. Naturally, the value of the voltage obtained at the output of rectifier 16 must be far below the voltage of the pulses in the mode of operation described above (pulsatory). In consequence, provision can be made on the secondary 13 of transformer 12 for a separate output for a second mode of operation with a commutation device permitting the actuation of either output according to the mode of operation envisaged.

While there has been described what is considered to be the best mode for carrying out the invention and the preferred embodiment thereof, it will be obvious that various changes and modifications may be made therein without departing from the scope of the invention.

I claim:

1. In a process for the thermochemical treatment of a metal selected from the group consisting of steel and steel alloys, wherein the metal is subjected to ionic bombardment in a furnace having a cathode electrode and an anode electrode, the metal being treated being disposed on said cathode electrode, and the furnace contains ammonia gas for use in carrying out the thermochemical treatment, and the gas is brought to a very low pressure, the improvement comprising the steps of:

establishing a DC voltage between said anode and cathode electrodes, to bring the metal as quickly as possible to the treatment temperature, and operating the furnace during a first period with said DC voltage at an operating point which lies in the zone of abnormal discharge of the voltage-intensity curve of the furnace and at a point far enough from the arc formation zone to eliminate as far as possible the possibility of formation of an arc, and then establishing a succession of voltage pulses of high voltage but limited energy between said cathode and said anode electrodes during a second period, the voltage of said succession of voltage pulses being higher than said DC voltage, and moving the operating point of the furnace along the voltage-intensity curve to a limit point far enough from the arc formation zone in order to prevent the formation of an arc during the course of each of the succession of the pulses with high voltage but limited energy.

2. The process as claimed in claim 1, including quantifying the energy of each of the voltage pulses by a capacitor.

3. The process as claimed in claim 1, including the controlling of a feed circuit for the furnace to feed first a DC continous voltage during said first period and then a succession of voltage pulses, in succession during said second period.

4. The process as claimed in claim 1, in which said establishing of a DC voltage includes the step of applying a continuous potential difference between said electrodes to obtain a permanent operative point with a direct current voltage close to point F on the voltage-intensity curve as shown in the graphical representation of FIG. 1, the point F being close to the arc regime zone, and said establishing of the succession of voltage pulses includes moving the operation point along the voltage-intensity curve from point O to a limit point distant from point F whereby to prevent the operation point from moving along the voltage-intensity curve to point G.

5. The process as claimed in claim 4, including controlling a feed circuit from a single source for the furnace to feed the two different types of voltages separately from each other and in succession.

* * * * *